US006612679B1

(12) United States Patent
Kawamata et al.

(10) Patent No.: US 6,612,679 B1
(45) Date of Patent: Sep. 2, 2003

(54) INK-JET RECORDER

(75) Inventors: Yutaka Kawamata, Mitaka (JP); Yasuyuki Takagi, Mitaka (JP); Keiji Okazawa, Mitaka (JP)

(73) Assignee: Canon Finetech Inc., Ibaraki (JP)

( * ) Notice: Subject to any disclaimer, the term of this patent is extended or adjusted under 35 U.S.C. 154(b) by 0 days.

(21) Appl. No.: 10/019,222

(22) PCT Filed: Jun. 30, 2000

(86) PCT No.: PCT/JP00/04365

§ 371 (c)(1),
(2), (4) Date: Dec. 28, 2001

(87) PCT Pub. No.: WO01/02175

PCT Pub. Date: Jan. 11, 2001

(30) Foreign Application Priority Data

Jul. 2, 1999 (JP) ..... 11-189794

(51) Int. Cl.[7] ..... B41J 29/393; B41J 25/308
(52) U.S. Cl. ..... 347/19; 347/8
(58) Field of Search ..... 347/19, 23, 14, 347/15, 16, 10, 11, 12, 17, 32, 8, 22, 30; 400/56, 55

(56) References Cited

U.S. PATENT DOCUMENTS

| | | | | |
|---|---|---|---|---|
| 5,187,497 A | * | 2/1993 | Hirano et al. | 347/8 |
| 5,751,301 A | * | 5/1998 | Saikawa et al. | 347/8 |
| 6,101,426 A | | 8/2000 | Kimura et al. | 700/219 |
| 6,126,345 A | | 10/2000 | Ito et al. | 400/624 |

FOREIGN PATENT DOCUMENTS

| | | |
|---|---|---|
| JP | 0 842 781 A | 5/1998 |
| JP | 0 879 705 A | 11/1998 |
| JP | 11049399 A | 2/1999 |
| JP | 11049400 A | 2/1999 |
| JP | 0 925 920 A | 6/1999 |
| JP | 11-170501 | 6/1999 |
| JP | 2000-185416 | 4/2000 |
| US | 0 540 245 | 5/1993 |

* cited by examiner

*Primary Examiner*—Raquel Yvette Gordon
*Assistant Examiner*—Charles W. Stewart, Jr.
(74) *Attorney, Agent, or Firm*—Rabin & Berdo, P.C.

(57) ABSTRACT

The invention provides an ink-jet recording apparatus capable of automatically adjusting the feed of a recording medium without troubling a user.

Such an ink-jet recording apparatus is provided with a means for forming at least two adjustment charts for one band by means of at least one nozzle disposed at both end portions of a print head, a nozzle width detecting means for detecting the nozzle width of the print head on the basis of information of two adjustment charts in the same band printed by both end portions, a feed detecting means for detecting an actual feed of the recording medium on the basis of information of adjustment charts printed in adjacent bands by either one end portion out of both end portions, and a compensating means for performing a compensation for a predetermined feed for one band of the recording medium on the basis of the detected nozzle width and the actual feed.

15 Claims, 5 Drawing Sheets

FIG. 7

| | Nozzle width | Actual feed |
|---|---|---|
| 1 | 144.5 | 143.5 |
| 2 | 144.5 | 143.5 |
| 3 | 145.5 | 144.5 |
| 4 | 145.5 | 144.5 |
| 5 | 144.5 | 143.5 |
| 6 | 145.5 | 144.5 |
| 7 | 144.5 | 143.5 |
| 8 | 145.5 | 144.5 |
| 9 | 145.5 | 144.5 |
| 10 | 144.5 | 143.5 |
| Average | 145.0 | 144.0 |

INK-JET RECORDER

TECHNICAL FIELD

The present invention relates to an ink-jet recording apparatus for forming an image on a recording medium such as a plain paper, an OHP paper and the like by jetting ink from nozzles of a print head.

BACKGROUND ART

As one of output devices for a computer, a workstation and the like, a recording apparatus of an ink-jet type for forming an image on a recording medium such as a recording paper and the like by jetting ink is known. The recording apparatus of an ink-jet type is usually provided with a print head having nozzles for jetting ink formed in it, a carriage having this print head mounted on it and going and returning in specific directions, and a recording medium feeder for feeding a recording medium in a direction (direction of feeding a recording medium) perpendicular to the specific directions.

When forming an image on a recording medium, the apparatus stops temporarily the recording medium being fed by a recording medium feeder and jets ink from nozzles on the basis of an image signal having image information as making a carriage go and return in the above-mentioned specific directions. By this, an image for one band is formed on an image forming area (band area) of the recording medium facing the outlets (ink outlets) of nozzles. After this, it feeds and stops the recording medium by the width of one band and again jets ink from the nozzles on the basis of an image signal as making the carriage go and return in the above-mentioned specific directions. By this, an image is formed on a new image forming area (band area) of the recording medium. An image is formed on the recording medium by repeating such an operation.

An image forming apparatus jetting ink like an ink-jet recording apparatus as described above repeats an operation of making a record for a nozzle width (one band) of a print head and then feeding a recording medium by a nozzle width and again making a record for the nozzle width. By the way, a recording medium feeder has a specific tolerance in accuracy in a machining or assembling process. Due to this, an actual feed for one band may be larger or smaller than a predetermined feed. When an actual feed of a recording medium for one band is larger, a dot gap portion appears in a joint between bands, and when it is smaller, a dot overlapped portion occurs.

And the nozzle width of a print head also may be larger or smaller than the feed of a recording medium for one band due to a tolerance in a machining process. In this case also, therefore, a dot gap portion or a dot overlapped portion appears in a joint between bands.

Due to this, up to now a user has adjusted the feed of a recording medium using an adjustment pattern or the like each time he/she replaces a print head.

However, it is a troublesome work to a user to confirm an adjustment pattern and adjust the feed of a recording medium, and further it is not easy for a user to make an accurate feed adjustment and this makes a cause for deterioration in image quality due to a poor adjustment.

DISCLOSURE OF THE INVENTION

The present invention has been performed in consideration of the above circumstances, and an object of the invention is to provide an ink-jet recording apparatus capable of automatically adjusting the feed of a recording medium without troubling a user.

In order to attain the above object, an ink-jet recording apparatus according to the present invention is an ink-jet recording apparatus which forms an image on a recording medium by repeating an operation of recording an image by jetting ink from a plurality of nozzles arranged in a print head as moving the print head along the recording medium and, after making a record for one band, feeding the recording medium by a specific distance by means of a recording medium feeding means and recording an image for the next one band, said ink-jet recording apparatus being provided with an adjustment image forming means for forming at least two adjustment images for one band by means of at least one nozzle disposed at both end portions out of nozzles arranged in said print head, a nozzle width detecting means for detecting the nozzle width of said print head on the basis of information of two adjustment images in the same band printed by said adjustment image forming means, and a compensating means for performing a compensation for a predetermined feed for one band of the recording medium on the basis of said detected nozzle width of the print head.

And an ink-jet recording apparatus according to the present invention is an ink-jet recording apparatus which forms an image on a recording medium by repeating an operation of recording an image by jetting ink from a plurality of nozzles arranged in a print head as moving the print head along the recording medium and, after making a record for one band, feeding the recording medium by a specific distance by means of a recording medium feeding means and recording an image for the next one band, said ink-jet recording apparatus being provided with an adjustment image forming means for forming one adjustment image for each band of a plurality of bands by means of some nozzles of said print head, a feed detecting means for detecting an actual feed of the recording medium on the basis of said adjustment images formed on adjacent bands, and a compensating means for performing a compensation for a predetermined feed for one band of the recording medium on the basis of said detected actual feed.

And an ink-jet recording apparatus according to the present invention is an ink-jet recording apparatus which forms an image on a recording medium by repeating an operation of recording an image by jetting ink from a plurality of nozzles arranged in a print head as moving the print head along the recording medium and, after making a record for one band, feeding the recording medium by a specific distance by means of a recording medium feeding means and recording an image for the next one band, said ink-jet recording apparatus being provided with an adjustment image forming means for forming at least two adjustment images for one band by means of at least one nozzle disposed at both end portions out of nozzles arranged in said print head, a nozzle width detecting means for detecting the nozzle width of said print head on the basis of information of two adjustment images in the same band printed by said adjustment image forming means, a feed detecting means for detecting an actual feed of the recording medium on the basis of information of either one adjustment image out of said adjustment images and an adjustment image printed in its adjacent band, and a compensating means for performing a compensation for a predetermined feed for one band of the recording medium on the basis of said detected nozzle width of the print head and said actual feed.

And an ink-jet recording apparatus according to the present invention is an ink-jet recording apparatus which forms an image on a recording medium by repeating an operation of recording an image by jetting ink from a plurality of nozzles arranged in a print head as moving the print head along the recording medium and, after making a record for one band, feeding the recording medium by a specific distance by means of a recording medium feeding means and recording an image for the next one band, said ink-jet recording apparatus being provided with an adjustment image forming means for forming two adjustment images for each band of a plurality of bands by means of at least one nozzle disposed at both end portions out of nozzles arranged in said print head, a detecting means for detecting an adjustment image formed on said recording medium by said adjustment image forming means and issuing a detection signal, a nozzle width detecting means for detecting the nozzle width of said print head by detecting said two adjustment images printed in the same band by means of said detecting means and measuring the distance between the two adjustment images as feeding the recording medium by means of said recording medium feeding means, a feed detecting means for detecting an actual feed for one band on the basis of adjustment images printed in adjacent bands by either one end portion out of said both end portions, said adjustment images being detected by said detecting means as feeding the recording medium by means of said recording medium feeding means, and a compensating means for performing a compensation for a predetermined feed for one band of the recording medium on the basis of said detected nozzle width of the print head and said actual feed.

BRIEF DESCRIPTION OF THE DRAWINGS

FIG. 7 is a table showing a measurement result.

BEST MODE FOR CARRYING OUT THE INVENTION

Composition of Embodiment

Figure 1:
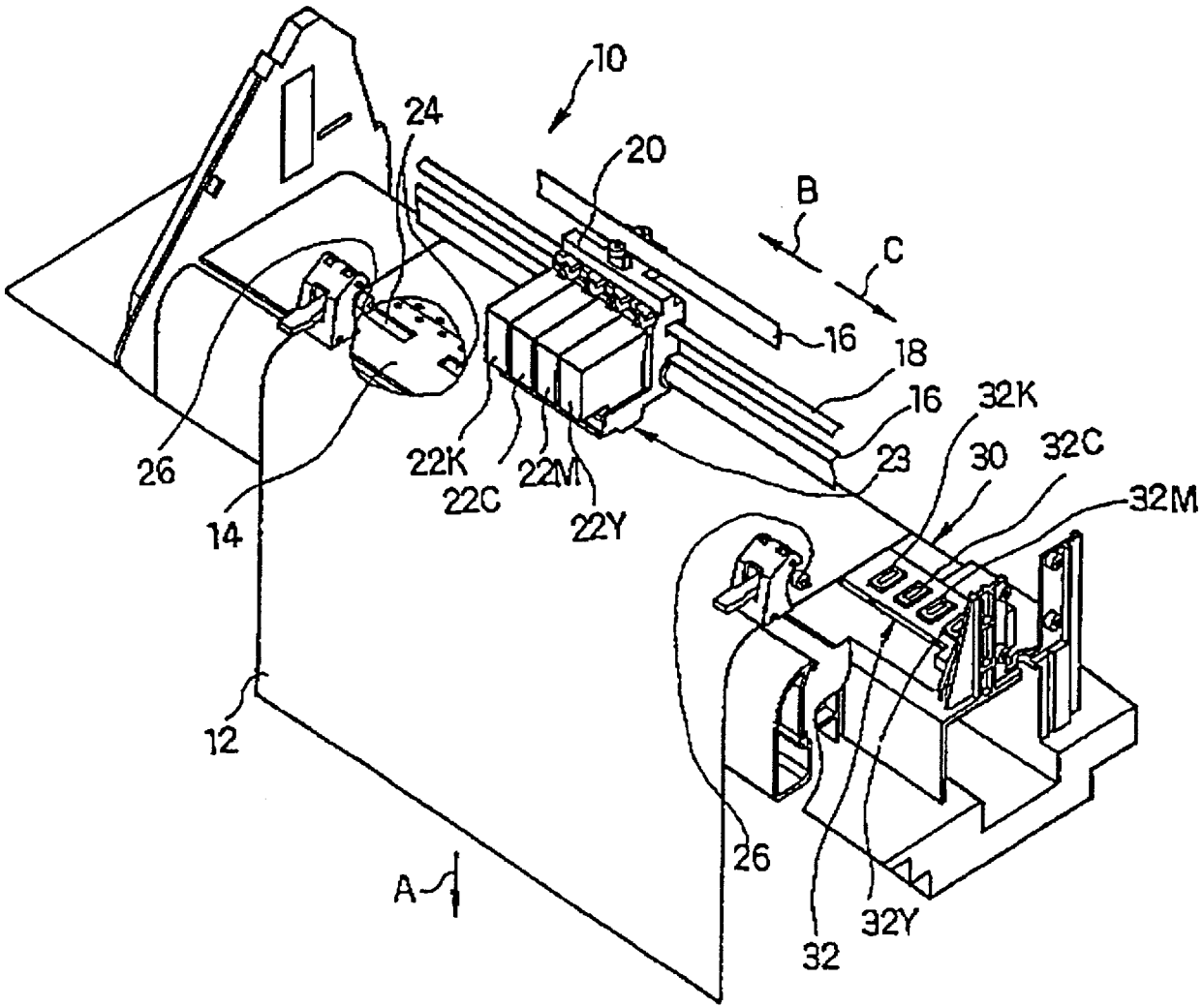
FIG. 1 is a perspective view showing a schematic composition of a plotter being an embodiment of the present invention.

A plotter being an embodiment of an ink-jet recording apparatus of the present invention is described with reference to the drawings in the following. FIG. 1 is a perspective view showing a schematic composition of a plotter being an embodiment of the present invention.

The plotter 10 is provided with a platen 14 on which a recording paper 12 to be fed in a direction shown by an arrow A is placed. Two scanning rails (guide rails) 16 are put above and in parallel with this platen 14. A carriage 20 to be made to go and return in directions of arrows B and C (directions perpendicular to the direction of arrow A) by a motor (not illustrated) and a belt 18 is mounted on the scanning rails 16 through a slide bearing (not illustrated).

The carriage 20 has four print heads 22K (black), 22C (cyan), 22M (magenta) and 22Y (yellow) mounted on it, said print heads each having ink jetting outlets (outlets of nozzles, not illustrated) to jet ink. An area in front of the ink jetting outlets is an image forming area (band area) 23 where an image is formed. Ink is jetted from the ink jetting outlets onto an area positioned at the image forming area (band area) 23 of the recording paper 12 and thereby an image for one band is formed.

A recovery device 30 which sucks forcibly ink from nozzles, cleans ink supplying paths and the nozzles formed in the print head 22 and recovers an ink jetting state of the print head 22 to the initial ink jetting state is arranged distantly from the image forming area 23 at a corner within a range in which the carriage 20 is movable.

In order to form an image on a recording paper 12 such as a roll paper and the like, the recording paper 12 is placed on the platen 14 and is held by a feed roller 24 which exposes a part of its outer circumferential face through an opening formed in the platen 14 and a pinch roller 26 to press both end portions of the recording paper 12 from the above. Then, the recording paper 12 is fed by turning the feed roller 24 by means of a feed motor (not illustrated). Above the recording paper 12, the carriage 20 is made to go and return in the directions of arrows B and C, and ink is jetted from the nozzles on the basis of an image signal carrying image information sent to the print heads 22K, 22C, 22M and 22Y from a head controller 4 (see FIG. 2). By this, an image is formed on an area positioned at the image forming area 23 on the recording paper 12. When a state where sucking ink from nozzles is necessary for cleaning the nozzles during an image forming operation is brought, the carriage 20 is moved to a position above the recovery device 30. When an image finishes being formed, a cutter (not illustrated) mounted on the carriage 20 is made to spring out to a specific position to cut out the recording paper 12 into a specified size.

The recovery device 30 is provided with four caps 32K, 32C, 32M and 32Y made of rubber to detachably cover the outlets of the nozzles of the four print heads 22K, 22C, 22M and 22Y respectively. Each of the caps 32K, 32C, 32M and 32Y has one end of a tube (not illustrated) connected to it, and the other end of this tube is connected to an suction pump (not illustrated). The four caps 32K, 32C, 32M and 32Y are fixed to a cap stand 32.

Figure 2:
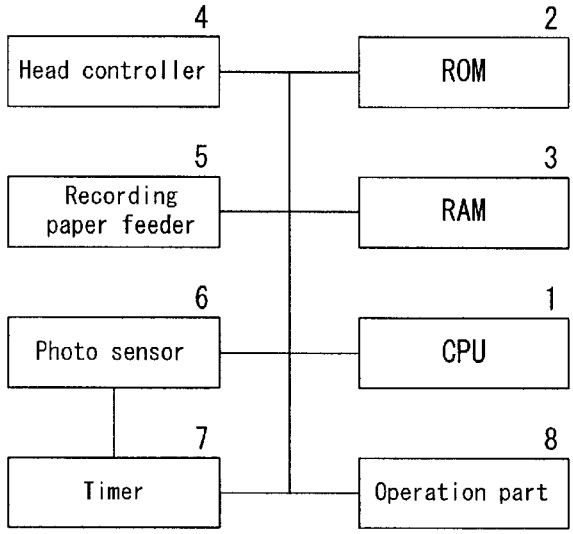
FIG. 2 is a control block diagram of the plotter being an embodiment of the present invention.

FIG. 2 is a control block diagram of the plotter being this embodiment. The plotter of this embodiment is provided with a CPU 1 to control the whole apparatus, a ROM 2 for storing a control program and various kinds of data in it in a nonvolatile state, a RAM 3 to be used as a working area for processing by the CPU 1 or a temporary memory area of data, a head controller 4 for sending an image signal carrying image information to print heads to control jetting of ink from each nozzle, a recording paper feeder 5 for feeding a recording paper, a photo sensor 6 for detecting an image printed on the recording paper, a timer 7 for counting the number of clocks on the basis of a specific signal sent from the photo sensor 6 on the basis of an instruction from the CPU 1, and an operation part 8 for performing operation and various settings.

Figure 3:
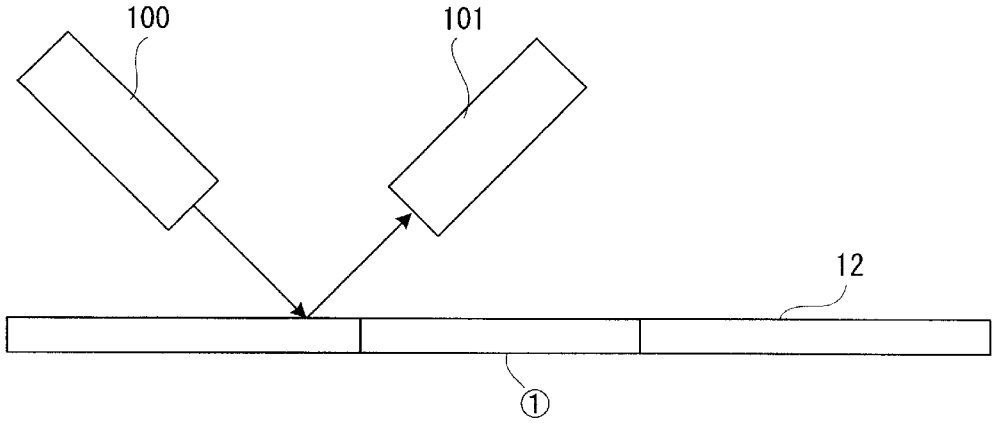
FIG. 3 is a schematic diagram of a photo sensor.

FIG. 3 is a schematic diagram of a photo sensor with which the plotter of this embodiment is provided. The photo sensor 6 of this embodiment is provided on the carriage 20 which the print heads are mounted on. This photo sensor 6 is a so-called reflection-type photo sensor having a light emitter 100 and a light receiver 101. Adjustment charts D described later have been printed on the recording paper 12. A light emitted from the light emitter 100 of the sensor is reflected by the recording paper and is received by the light receiver 101. In the above composition, the positions of adjustment charts on the recording paper 12 are detected by detecting the amount of light reflected by a non-printed portion and a printed portion as feeding the recording paper 12 at a specified speed. This photo sensor 6 is arranged so that the higher the density of an image is, the higher its output potential is made.

Figure 4:
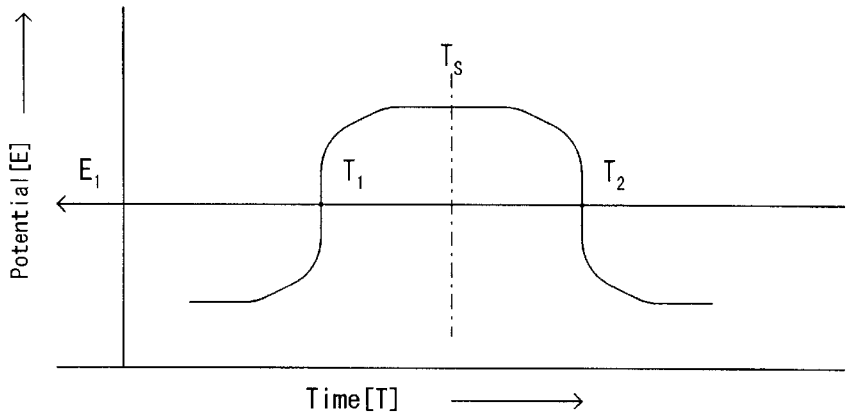
FIG. 4 is a diagram showing an output signal of the photo sensor.

FIG. 4 is a diagram showing an output signal of the photo sensor. In FIG. 4, the ordinate represents the output potential of the photo sensor and the abscissa represents time. Potential El is a threshold potential, and a potential higher than this represents a signal from a printed portion and a potential lower than this represents a signal from the recording paper. T1 is a point on a boundary line where a white paper portion is changed to a printed portion, and T2 is a point on a boundary line (T2) where a printed portion is changed to a white paper portion. An image portion between T1 and T2 is an adjustment chart. The timer 7 of this embodiment is composed of an ASIC (application specific IC) and is designed in circuit so as to deal with the middle point Ts between T1 and T2 as a detection timing of an adjustment chart. However, the present invention is not limited to this, and a detection time of the adjustment chart may be T1 or T2.

When the CPU 1 sends an instruction of counting to the timer 7, on the basis of this instruction the timer 7 sees the output signal of the photo sensor 6 and starts counting the clocks from said middle point Ts and ends the counting at the next middle point. The counting result is sent to the CPU 1. The CPU 1 performs a compensation described later on the basis of the count number which have been sent from the timer 7 and the feed speed of the recording paper.

Printing of Adjustment Charts

Figure 5:
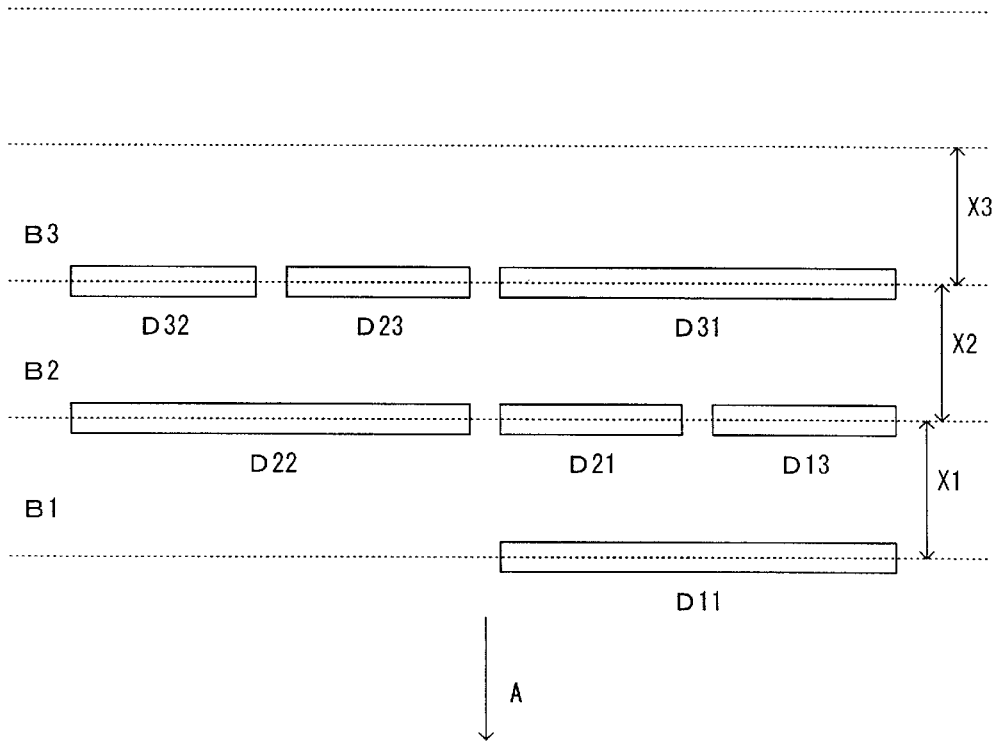
FIG. 5 is a partial magnified view showing an example of adjustment charts.

Next, printing of adjustment charts in the plotter of this embodiment is described. FIG. 5 is a partial magnified view showing an example of adjustment charts in this embodiment. In the plotter of this embodiment, the nozzle width of a print head (the width of nozzles to be used for forming an actual image) is a width for 144 dots, but 154 nozzles in total are provided in the print head. When printing adjustment charts of this embodiment, ten nozzles positioned at both end portions out of the whole nozzles are used. In this embodiment, therefore, the line width of the adjustment chart D is printed with 10 dots. And since one band (nozzle width of a print head) of this embodiment is a width for 144 dots, the feed of a recording paper is set in advance to a feed for 144 dots. Hereinafter, this predetermined feed is also referred to as a theoretical feed. As described above, since a print head and a recording paper feeder 5 have tolerances, feeding a recording paper by a theoretical feed may cause a dot gap or a dot overlapped portion between bands. Due to this, it is necessary to adjust the feed to prevent occurrence of such a gap or an overlapped portion. The plotter of this embodiment performs automatically such an adjustment (compensation) of the feed of a recording paper. In FIG. 5, X represents a feed of a recording paper for one band (for 144 dots), B represents one band, and A represents a direction of feeding a recording paper. In this embodiment, the distance between adjustment charts D printed by the nozzles positioned at both end portions of the whole nozzles in the same band coincide with the nozzle width of the print head. And the pitch between adjustment charts D printed by either one end portion of both the end portions is an actual feed of a recording paper.

The adjustment charts are printed for ten bands in total. Adjustment charts D11 and D13 are printed for the first band B1. Next, a recording paper is fed by a distance for one band (for 144 dots) by the recording paper feeder and printing for the second band B2 is performed. Adjustment charts D21, D22 and D23 are printed for the second band. Next, the recording paper 12 is further fed by a distance for one band by the recording paper feeder 5 and printing for the third band B3 is performed. Adjustment charts D31, D32 and D33 are printed for the third band. In the same way after this, printing for the fourth to tenth bands is performed. In FIG. 5, adjustment chart D13 is collinear with adjustment charts D22 and D21, but actually since it is rare that the nozzle width of a print head and the feed of a recording paper are the same as each other, the adjustment chart D13 is not collinear with but slightly slipped from adjustment charts D22 and D21.

Detection of Adjustment Charts

Figure 6:
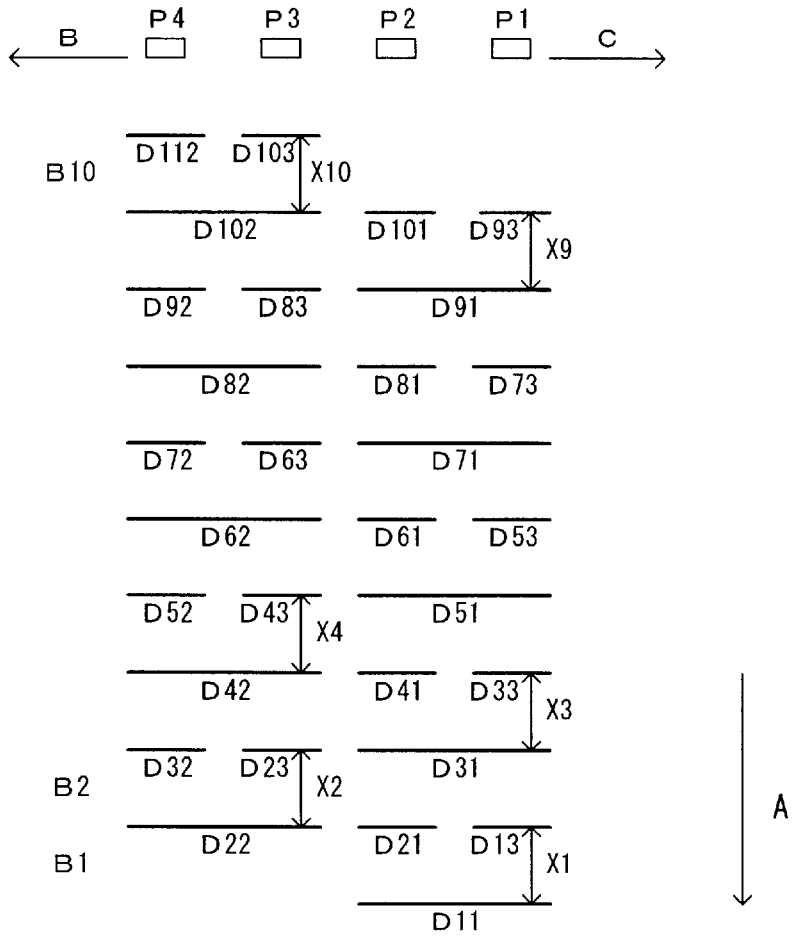
FIG. 6 is a diagram showing the whole of adjustment charts.

FIG. 6 is a diagram showing the whole of adjustment charts printed as described. Next, a method for detecting the nozzle width of a print head and an actual feed of a recording paper using adjustment charts produced as described above is described. When adjustment charts finish being printed, the CPU 1 sends a signal to the recording paper feeder 5 and feeds back the recording paper 12 having the adjustment charts for ten bands formed on it in the reverse direction. Next, it feeds again the recording paper in the direction A. The photo sensor detects the adjustment charts at a detection position described later. In this embodiment, the carriage moves the photo sensor and stops it at four detection positions P1, P2, P3 and P4 shown in FIG. 6. Following this, at each of the detection positions the photo sensor detects the adjustment charts as the CPU 1 feeds the recording paper in the direction A. Positions P1 and P3 is positions for detecting the adjustment charts printed within the same band. The nozzle width of a print head is detected by means of the adjustment charts detected at the positions P1 and P3. At the sensor position P1, signals are issued by detecting adjustment charts of odd-numbered bands, namely, adjustment charts D11 and D13, D31 and D33, D51 and D53, D71 and D73, and D91 and D93. At the sensor position P3, signals are issued by detecting adjustment charts of even-numbered bands, namely, adjustment charts D22 and D23, D42 and D43, D62 and D63, D82 and D83, and D102 and D103.

Positions P2 and P4 are positions for detecting adjustment charts of adjacent bands. An actual feed for one band of a recording paper is detected from adjustment charts detected at these positions P2 and P4. At the sensor position P2, signals are issued by detecting adjustment charts of odd-numbered bands, namely, adjustment charts D11 and D21, D31 and D41, D51 and D61, D71 and D81, and D91 and D101. At the sensor position P4, signals are issued by detecting adjustment charts of even-numbered bands, namely, adjustment charts D22 and D32, D42 and D52, D62 and D72, D82 and D92, and D102 and D112.

The CPU 1 sends a signal for feeding a recording paper in the direction A to the recording paper feeder 5 and issues an instruction signal for counting to the timer 7. The timer 7, when it receives the instruction signal from the CPU 1, sees a detection signal of an adjustment chart as described above sent by the photo sensor and counts clocks. For example, when the photo sensor is at a stop at position P1, on reception of a detection signal of adjustment chart D11 the timer 7 starts counting clocks from the middle point Ts, and on reception of a detection signal of adjustment chart D13 the timer 7 ends counting clocks at the middle point Ts, and sends the result of counting to the CPU 1. In a similar manner, it counts clocks between adjustment charts of the remaining odd-numbered bands and sends the result of counting to the CPU 1. In a similar manner also when the photo sensor 6 is at a stop at position P3, it counts clocks between adjustment charts of even-numbered bands and outputs the result of counting.

And when the photo sensor is at a stop at position P2, on reception of a detection signal of adjustment chart D11 the timer 7 starts counting clocks from the middle point Ts, and on reception of a detection signal of adjustment chart D21 the timer 7 ends the counting and outputs the result of counting to the CPU 1. In a similar manner after this, it sees a detection signal of adjustment charts of the remaining odd-numbered bands and counts clocks. In a similar manner also when the photo sensor 6 is at a stop at position P4, it counts clocks between adjustment charts of even-numbered bands and outputs the result. The CPU 1 computes the length between adjustment charts on the basis of the count number from the timer 7, the clock frequency of the counter and the feed speed of the recording paper.

The reason why the nozzle width of a print head and an actual feed of a recording paper are respectively detected at two separate positions instead of one position as described above is that the detection at one position results in making the photo sensor detect at the same time, for example, an adjustment chart to end counting the first band B1 and an adjustment chart to start counting the second band B2 when detecting the nozzle width of a print head and making it impossible to distinguish signals of both adjustment charts from each other.

Compensation for Feed

The plotter of this embodiment prints adjustment charts for ten bands and measures the nozzle width of a print head and an actual feed of a recording paper at ten times in total. A table shown in FIG. 7 is a table showing the result of measurement. Numerical values shown in FIG. 7 represent measured lengths represented in number of dots. Because the feed of a recording paper is controlled in number of dots. In case of this embodiment, one dot corresponds to 70 microns. As seen apparently from this table, the average value of the nozzle widths of print heads is 145 dots and the average value of actual feeds is 144 dots. Therefore, when this print head is used to print without adjustment, since the nozzle width of this print head is larger by a width for one dot than the actual feed, an overlapped portion in the shape of a black line for one dot appears on a formed image. In such a case the plotter of this embodiment automatically adjusts the feed of a recording paper. That is to say, the amount of compensation is computed by the following expression using the average value of the nozzle widths of print heads and the average value of actual feeds obtained by measurement.

$$\text{Amount of compensation}=(\text{theoretical feed}\times(\text{nozzle width}/\text{actual feed}))-\text{theoretical feed}$$

When entering measured numerical values into the above expression,

Amount of compensation=$(144\times(145/144))-144=1$ is obtained. The CPU adds this computed amount of compensation "1" to the theoretical feed, namely, sends a value obtained by adding 1 dot to the theoretical feed (144 dots) to the recording paper feeder as the feed. Thus, the plotter forms an image for each band as controlling the feed of a recording paper. By this, since the feed of a recording paper and the nozzle width of a print head are made to coincide exactly with each other, it is possible to eliminate any overlap or gap and improve the quality of an image.

The compensation for feed may be automatically performed when a print head is replaced by providing a photo sensor for detecting replacement of a print head, and may be performed when receiving an instruction of compensation from a user.

Effect of Embodiment

According to this embodiment described above, since adjustment charts are printed using nozzles at both ends of the same print head, the nozzle width of the print head can be exactly detected. And by detecting the distance between adjustment charts of two adjacent bands printed using a part of a print head, it is possible to exactly detect an actual feed of a recording paper. Further, by using the detected nozzle width of a print head and the actual feed of a recording paper it is possible to automatically compensate for the theoretical feed without troubling a user.

And according to this embodiment described above, it is possible to suppress degradation in image quality caused by eccentricity of the feed roller 24 to feed a recording paper on the platen. If the feed roller is eccentric, when the shorter radius of the roller feeds a recording paper the feed for one band is made smaller and an overlapped portion appears on a formed image. And when the longer radius of the roller feeds the recording paper the feed for one band is made larger and a gap portion appears between bands. On the other hand, the plotter of this embodiment prints and measures adjustment charts for ten bands(at ten times), and compensates for the feed on the basis of the average value of those measurements. The length of printed adjustment charts for ten bands is made the same as the length of the outer circumference of the feed roller 24. By measuring adjustment charts having a length integer times the length of the outer circumference of the feed roller and performing compensation, it is possible to determine the feed of a recording paper taking the average of the portion being smaller in feed and the portion being larger in feed. Therefore, even in case that the feed roller is eccentric, it is possible to reduce an overlapped portion or a gap portion.

And according to this embodiment, even in case of performing a multi-pass printing, it is possible to improve the quality of an image. In a multi-pass printing, for example, in case that the number of passes is two, the first pass printing prints an image for each band so as to be a checkered pattern using dots for 72 nozzles, and the second pass printing prints so as to fill the remaining portions among the first checkered pattern using dots for 72 nozzles. At this time, if the feed of a recording paper is not accurate, the second pass printing may generate dot-overlapped portions or gap portions between dots. On the contrary, according to this embodiment, even in case of a multi-pass printing, it is possible to surely suppress generation of such overlapped portions or gap portions and therefore suppress irregularity in impact area of an image and improve the quality of the image.

Other Embodiments

The present invention is not limited to the above-mentioned embodiment but can be modified variously within the scope of the essential points of it. For example, although the above embodiment has been described in case of detecting the nozzle width of a print head and an actual feed of a recording paper and compensating for a theoretical feed, for example when an accurate machining process can be performed and the tolerance of a print head is negligibly small, the compensation may be performed by detecting only an actual feed of a recording paper. Similarly, when the tolerance of the recording paper feeder is negligibly small, the compensation may be performed by detecting only the nozzle width of a print head.

And although the above embodiment has been described in case of printing an adjustment chart using ten nozzles at both end portions of a print head, the number of dots for printing the adjustment chart may be larger or smaller than ten if it is not less than one dot.

And although the above embodiment has been described in case that the total length of the whole of adjustment charts is integer times the length of the outer circumference of the feed roller, the total length of the whole of adjustment charts does not need to be integer times the length of the outer circumference of the feed roller.

And although the plotter of the above embodiment has used nozzles at end portions of a print head in order to detect an actual feed of a recording paper, it is possible also to use nozzles at other portions of a print head in order to detect an actual feed of a recording paper.

As described above, since the present invention detects the nozzle width of a print head using adjustment images and automatically compensates for the feed of a recording medium on the basis of this result, it can automatically adjust the feed of a recording medium without troubling a user.

And since the present invention detects an actual feed of a recording medium using adjustment images and automatically compensates for the feed of a recording medium on the basis of this result, it can automatically adjust the feed of a recording medium without troubling a user.

And since the present invention detects the nozzle width of a print head and an actual feed of a recording medium using adjustment images and automatically compensates for the feed of a recording medium on the basis of these results, it can automatically adjust the feed of a recording medium without troubling a user.

INDUSTRIAL APPLICABILITY

The present invention can be applied to an ink-jet recording apparatus for forming an image on a recording medium such as a plain paper and the like by jetting ink from nozzles of a print head.

What is claimed is:

1. An ink-jet recording apparatus which forms an image on a recording medium by repeating an operation of recording an image by jetting ink from a plurality of nozzles arranged in a print head as moving the print head along the recording medium and, after making a record for one band, feeding the recording medium by a specific distance by means of a recording medium feeding means and recording an image for the next one band, said ink-jet recording apparatus being provided with;

an adjustment image forming means for forming at least two adjustment images for one band by means of at least one nozzle disposed at both end portions out of nozzles arranged in said print head, a nozzle width detecting means for detecting the nozzle width of said print head on the basis of information of two adjustment images in the same band printed by said adjustment image forming means, and a compensating means for performing a compensation for a predetermined feed for one band of the recording medium on the basis of said detected nozzle width of the print head.

2. An ink-jet recording apparatus according to claim 1, further comprising a head replacement detecting means for detecting replacement of said print head, and performing said compensation when said head replacement detecting means has detected replacement of a print head.

3. An ink-jet recording apparatus according to claim 2, further comprising a feed roller for feeding said recording medium in a printing operation, wherein the length of each of said adjustment images in the direction of feeding said recording medium is such that an integral number of said adjustment images has a total length equal to the outer circumference of said feed roller.

4. An ink-jet recording apparatus which forms an image on a recording medium by repeating an operation of recording an image by jetting ink from a plurality of nozzles arranged in a print head as moving the print head along the recording medium and, after making a record for one band, feeding the recording medium by a specific distance by means of a recording medium feeding means and recording an image for the next one band, said ink-jet recording apparatus being provided with;

an adjustment image forming means for forming one adjustment image for each band of a plurality of bands by means of some nozzles of said print head, a feed detecting means for detecting an actual feed of the recording medium on the basis of said adjustment images formed on adjacent bands, and a compensating means for performing a compensation for a predetermined feed for one band of the recording medium on the basis of said detected actual feed.

5. An ink-jet recording apparatus according to claim 4, wherein;

the length of said adjustment images in the direction of feeding said recording medium is formed so as to be integer times the length of the outer circumference of a feed roller for feeding said recording medium in a printing operation.

6. An ink-jet recording apparatus according to claim 4, further comprising a head replacement detecting means for detecting replacement of said print head, and performing said compensation when said head replacement detecting means has detected replacement of a print head.

7. An ink-jet recording apparatus which forms an image on a recording medium by repeating an operation of recording an image by jetting ink from a plurality of nozzles arranged in a print head as moving the print head along the recording medium and, after making a record for one band, feeding the recording medium by a specific distance by means of a recording medium feeding means and recording an image for the next one band, said ink-jet recording apparatus being provided with;

an adjustment image forming means for forming at least two adjustment images for one band by means of at least one nozzle disposed at both end portions out of nozzles arranged in said print head, a nozzle width detecting means for detecting the nozzle width of said print head on the basis of information of two adjustment images in the same band printed by said adjustment image forming means, a feed detecting means for detecting an actual feed of the recording medium on the basis of information of either one adjustment image out of said adjustment images and an adjustment image printed in its adjacent band, and a compensating means for performing a compensation for a predetermined feed for one band of the recording medium on the basis of said detected nozzle width of the print head and said actual feed.

8. An ink-jet recording apparatus according to claim 7, further comprising a head replacement detecting means for detecting replacement of said print head, and performing said compensation when said head replacement detecting means has detected replacement of a print head.

9. An ink-jet recording apparatus according to claim 7, wherein;

the length of said adjustment images in the direction of feeding said recording medium is formed so as to be integer times the length of the outer circumference of a feed roller for feeding said recording medium in a printing operation.

10. An ink-jet recording apparatus which forms an image on a recording medium by repeating an operation of recording an image by jetting ink from a plurality of nozzles arranged in a print head as moving the print head along the recording medium and, after making a record for one band, feeding the recording medium by a specific distance by means of a recording medium feeding means and recording an image for the next one band, said ink-jet recording apparatus being provided with;

an adjustment image forming means for forming two adjustment images for each band of a plurality of bands by means of at least one nozzle disposed at both end portions out of nozzles arranged in said print head, a detecting means for detecting an adjustment image formed on said recording medium by said adjustment image forming means and issuing a detection signal, a nozzle width detecting means for detecting the nozzle width of said print head by detecting said two adjustment images printed in the same band by means of said detecting means and measuring the distance between the two adjustment images as feeding the recording medium by means of said recording medium feeding means, a feed detecting means for detecting an actual feed for one band on the basis of adjustment images printed in adjacent bands by either one end portion out of said both end portions, said adjustment images being detected by said detecting means as feeding the recording medium by means of said recording medium feeding means, and a compensating means for performing a compensation for a predetermined feed for one band of the recording medium on the basis of said detected nozzle width of the print head and said actual feed.

11. An ink-jet recording apparatus according to claim 10, wherein;

said nozzle width detecting means detects the nozzle width of said print head by counting clocks between two detection signals sent from said detecting means, and said feed detecting means detects said feed for one band by counting clocks between two detection signals sent from said detecting means.

12. An ink-jet recording apparatus according to claim 11, further comprising a head replacement detecting means for detecting replacement of said print head, and performing said compensation when said head replacement detecting means has detected replacement of a print head.

13. An ink-jet recording apparatus according to claim 11, wherein;

the length of said adjustment images in the direction of feeding said recording medium is formed so as to be integer times the length of the outer circumference of a feed roller for feeding said recording medium in a printing operation.

14. An ink-jet recording apparatus according to claim 10, further comprising a head replacement detecting means for detecting replacement of said print head, and performing said compensation when said head replacement detecting means has detected replacement of a print head.

15. An ink-jet recording apparatus according to claim 10, wherein;

the length of said adjustment images in the direction of feeding said recording medium is formed so as to be integer times the length of the outer circumference of a feed roller for feeding said recording medium in a printing operation.

* * * * *